United States Patent [19]

Glazer

[11] 4,060,937

[45] Dec. 6, 1977

[54] GRINDER FOR GLASS PLATES OR THE LIKE

[75] Inventor: Joseph Glazer, Eastlake, Ohio

[73] Assignee: Morse Safety Products Co., Cleveland, Ohio

[21] Appl. No.: 726,588

[22] Filed: Sept. 27, 1976

[51] Int. Cl.[2] ..... B24B 9/10

[52] U.S. Cl. ..... 51/80 A; 51/215 H; 271/267

[58] Field of Search ..... 51/74 R, 80 A, 112, 51/137, 215 R, 215 CP, 215 H; 271/225, 184, 267; 198/580, 339, 472, 648

[56] References Cited

U.S. PATENT DOCUMENTS

| | | | |
|---|---|---|---|
| 732,767 | 7/1903 | Metzner | 51/80 A |
| 1,857,832 | 5/1932 | Bailey | 51/80 A |
| 1,933,640 | 11/1933 | Schafer | 51/80 A |
| 2,194,757 | 3/1940 | Klaas | 51/80 A |
| 2,593,606 | 4/1952 | Price | 51/80 A |
| 2,671,992 | 3/1954 | Reaser | 51/80 A |
| 3,805,455 | 4/1974 | Aellig | 51/80 A |

FOREIGN PATENT DOCUMENTS

| | | | |
|---|---|---|---|
| 1,456,954 | 2/1969 | Germany | 198/580 |

*Primary Examiner*—James L. Jones, Jr.
*Assistant Examiner*—Nicholas P. Godici

[57] ABSTRACT

An automatic grinding machine is disclosed for finishing the edges of rectangular articles such as the glass plates used in welder's helmets. The machine includes an inclined channel to receive a supply of plates provided with an escapement mechanism at its lower end which operates to release a single glass plate during each machine cycle. The plates are pushed by a linear actuator along first track. Grinding wheels located along the first track grind opposed edges of the plates as they move along such track. A second track intersects the first track at right angles and a second linear actuator pushes single glass plates into the second track after they are delivered to the entrance end of the second track from the first track. As the plates move along the second track the other opposed edges are finished by a pair of grinding wheels.

8 Claims, 7 Drawing Figures

GRINDER FOR GLASS PLATES OR THE LIKE

BACKGROUND OF THE INVENTION

This invention relates generally to grinding machines and more particularly to a novel and improved machine for automatically grinding the edges of flat rectangular articles such as the rectangular glass plates used in welder's hoods or the like.

PRIOR ART

Rectangular glass plates for use in welders' helmets are usually cut to size from sheets of glass and in the as-cut condition eight sharp edges exist. Therefore the practice is then to hand grind the edges so that the plate can be handled without injury.

The hand grinding of such plates is costly, often is not uniformly accomplished and often results in damage or scratching of the glass.

A machine for automatically grinding the edges of the rectangular glass plates is believed to be manufactured by Glass Machine Specialties, Inc. of Toledo, Ohio. Such machine is complicated and expensive. In such machine, parts are placed manually on a load conveyor section and are located, clamped and conveyed between a first pair of spindles which grind the short edges. The parts are then unclamped, indexed 90°, relocated, reclamped, and conveyed between a second pair of spindles which grind the long edges.

Other grinding machines are known for the edge finishing of rectangular parts. For example, the U.S. patent to Perrault U.S. Pat. No. 1,453,175 discloses a grinding machine for edge grinding rectangular objects such as for example, hard rubber covers of battery boxes or cells. Such machine a first conveyor operates to carry the part between a first pair of grinders which operate to grind first opposed edges of the part. The first conveyor delivers a part to a second conveyor extending at right angles to the first conveyor. The second conveyor is described as operating to carry the parts in a direction perpendicular to the first conveyors so that the remaining two opposed edges are ground by a second grinding mechanism positioned along the second conveyor. Other U.S. patents describe examples of machines for grinding various types of articles including glass plates or the like. Examples of such patents are U.S. Pat. Nos. 1,503,586 dated Aug. 5, 1924; 1,617,106 dated Feb. 8, 1927; 2,787,871 dated Apr. 9, 1957; 2,826,872 dated Mar. 18, 1958 and 3,187,467 dated June 8, 1965.

SUMMARY OF THE INVENTION

In accordance with the present invention a simplified machine is provided for grinding or otherwise finishing the edges of flat rectangular objects such as the glass plates used in welder's helmets or the like. In accordance with one important aspect of this invention, a simplified structure is provided for moving the parts through the machine without requiring a power conveyor or the like. In the illustrated embodiment, a pair of track assemblies are provided extending at right angles to each other. A pusher engages the article at the entrance end of the first track means and through such first article pushes the entire row of articles along the first track to the entrance end of the second track. A second pusher operating out of phase with the first pusher then engages the article at the entrance end of the second track assembly and pushes such article and the entire row of articles along the second track assembly.

Located along the first track assembly intermediate its ends is a grinding system for finishing a first pair of opposed edges. A second grinding system is provided along the second track means for finishing the remaining opposed edges of the article.

In accordance with another important aspect of this invention automatic means, powered by the first pusher, operate to feed single pieces of glass to the first track assembly from a stack of glass articles so that the machine is automatically fed from a supply of parts to be finished rather than being manually fed.

These and other aspects of this invention will become apparent from the following description of the drawings.

DETAILED DESCRIPTION OF THE DRAWINGS

Figure 1:
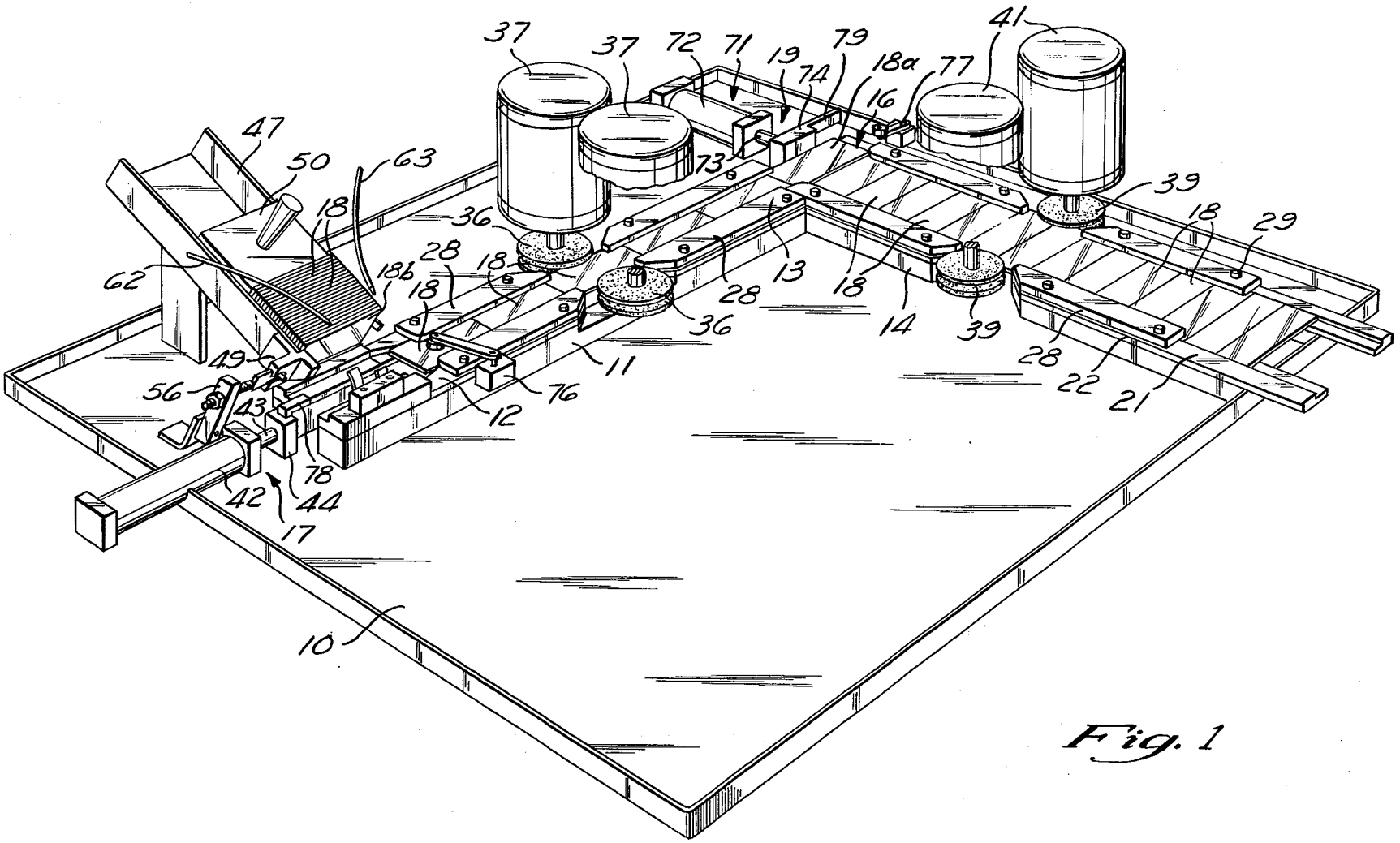
FIG. 1 is a schematic perspective view of a preferred machine incorporating the present invention.

FIG. 1 illustrates the overall machine in accordance with a preferred embodiment of this invention. In this machine the various components are supported on a base 10 which is flanged to retain coolant applied during the grinding operation and is provided with drain and pump (not illustrated) so that the coolant can be pumped back into the grinding area.

A first track assembly 11 extends from an entrance end 12 to an exit end at 13 where it intersects a second track assembly 14. The two track assemblies 11 and 14 extend at right angles to each other with the entrance end of the track assembly 14 at the intersection 16 of the two track assemblies.

A first pusher assembly 17 is mounted adjacent to the entrance end 12 of the first track section 11 and operates to engage a glass plate 18 and push the plate into the first track assembly 11 through a distance equal to the length of the plate. As the first plate is pushed into the track assembly 11 it engages the row of abutting plates 18 extending along the length of the track assembly 11 and causes the entire row to move axially toward the exit end and causes the forwardmost plate **18*a* in the row to be positioned in alignment with the second track assembly 14. Mounted at the entrance end of the second track assembly 14 is a second pusher assembly 19 which operates to engage a side edge of the glass plate 18*a* and to push it into the second track assembly causing it to engage the rearwardmost glass plate in the track assembly 14 and to move the entire row of plates along the second track assembly to the exit end thereof at 21**.

Figure 6:
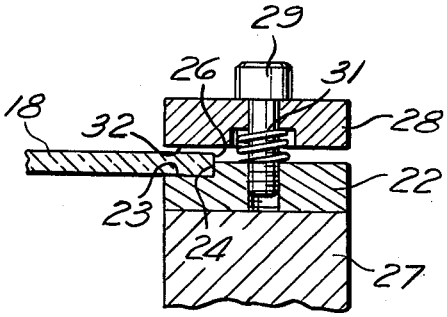
FIG. 6 is an enlarged fragmentary side elevation illustrating a typical section of the track system.

The track assemblies 11 and 14 are structured to embrace opposite edges of the glass plates 18 as illustrated in FIG. 6 to guide such plates for movement along the length of the track. FIG. 6 illustrates the structure of the track along one side of one of the track assemblies and is similar but opposite to the opposed side of the track. Preferably the track includes a lower track member 22 formed with a horizontal step providing a support surface 23 and an upstanding surface 24 which cooperate to engage and support the associated edge 26 of the plate 18. The lower track member is preferably mounted on a support bar 27 which is in turn mounted on the base 10.

An upper track member 28 is positioned above the lower track member 22 by a bolt fastener 29 which threads into the lower track member for vertical adjustment. A spring 31 is positioned around the bolt to urge the upper track member upwardly against the head thereof. A plurality of such bolt fasteners are positioned along the length of the upper track member and provides for accurate vertical adjustment of the upper track member with respect to the lower track member so that a slight clearance is provided between the lower surface 32 of the upper track member and the upper surface of the glass plate. The various elements are proportioned and positioned so that the glass plates are closely located by the two opposed track members with track members embracing opposite side edges of the glass plates as the glass plates are moved along the track assemblies.

Figure 7:
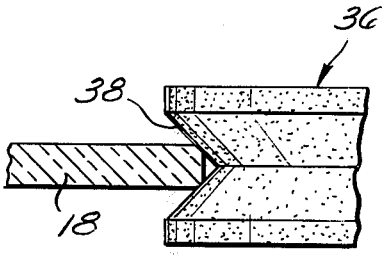
FIG. 7 is an enlarged fragmentary view illustrating one of the grinding wheels and the manner in which it functions to grind the edges of the glass plate.

Mounted along the first track assembly 11 are a pair of motor driven grinding wheels 36. An opening is provided in the track assembly to receive such wheels. In the illustrated embodiment a separate drive motor 37 is provided for each of the grinding wheels 36 and the wheels and motors are supported for lateral and vertical adjustment by a suitable structure not illustrated. Preferably the grinding wheels are formed with a V-groove 38 at their periphery as best illustrated in FIG. 7 and are positioned so that they engage the adjacent edge of a glass plate moving along the first track assembly and bevel the two sharp edges. When manufacturing welding helmet plates it is merely necessary to remove the sharp edges and not necessary to fully grind the edges. However, in instances where full grinding is required, appropriate grinding wheels may be employed. Preferably the grinding wheels 36 are provided with diamond surfaces so that the wheels can operate to grind a large quantity of glass plates before encountering any appreciable wear.

A similar pair of grinding wheels 39 are provided intermediate the ends of the track assembly 14 and are in turn driven by associated motors 41. As the pieces of glass plate 18 move along the track assembly 11 the opposed side edges of the glass plate are beleved and as the plate is then carried along the second track assembly 14 the opposed end edges are beveled so that all of the edges of the glass plate are properly and uniformly beveled as the plates are moved through the machine.

In the illustrated embodiment the wheels turn in the same direction and the force on the glass is neutralized. Therefore there is no tendency for the plates to be propelled forward by the wheels. Consequently a clean and uniform grinding action is provided as the pusher moves the plates past the wheels. Further in the illustrated system there is enough friction in the row ahead of the wheels to prevent the wheel from kicking the plates back as the pusher retracts to feed a subsequent plate.

The first pusher assembly 17 includes a piston and cylinder actuator in which the cylinder 42 is mounted on the base 10 and the piston 43 is reciprocable back and forth between a retracted position illustrated in FIG. 1 and an extended position. Mounted on the end of a piston is a pusher plate 44 having a forward face 46 which actually engages the edge of a glass plate 18 to push the plate into the track assembly.

A supply of glass plates 18 is stacked on edge within a supply channel 47 which is inclined downwardly toward the entrance end of the first track assembly 11 with the lowermost plates in the stack of the supply being engaged by and retained in the stack by an escapement mechanism arranged to release a single plate for feeding by the pusher plate 44 into the track assembly. If required a weight 50 is positioned in the channel above the supply of plates to press the stack downwardly.

Figure 2:
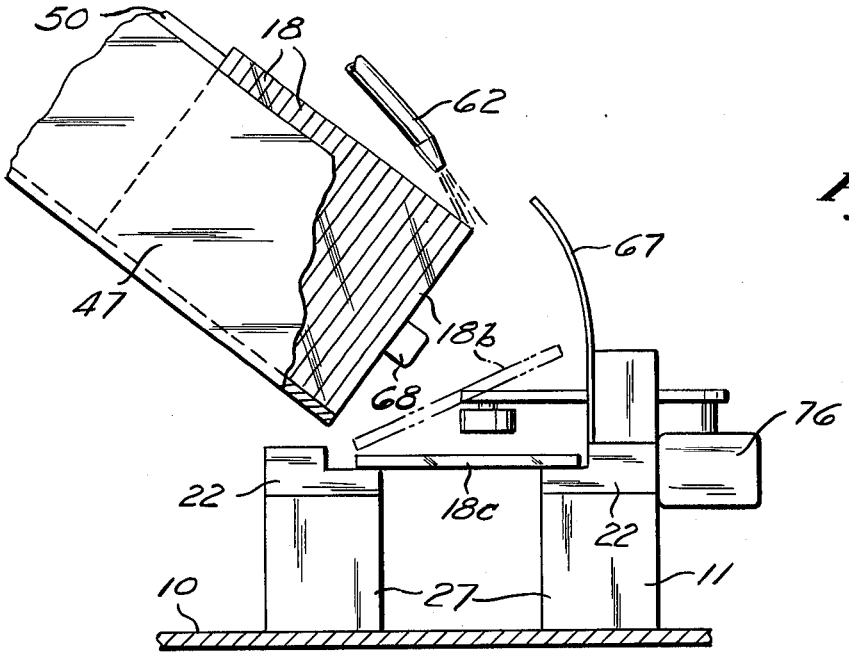
FIG. 2 is an enlarged fragmentary side elevation illustrating the automatic feed section of the machine.
Figure 3:
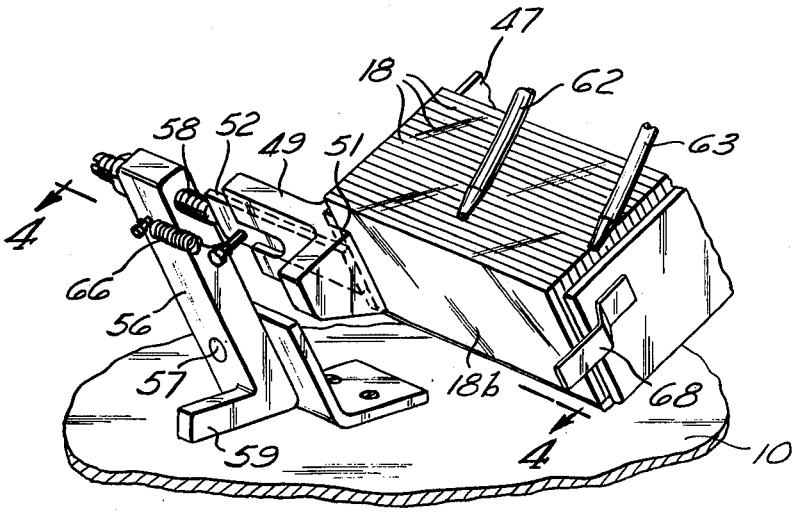
FIG. 3 is a fragmentary perspective view of the feed mechanism for supplying individual glass plates to the entrance end of the first track system.

The escapement mechanism is best illustrated in FIG. 3 and includes a fixed member 49 having a shoulder 51 which extends inwardly of the channel 47 and engages the face of the lowermost glass plate 18 within the channel 47. A reciprocating pusher slide 52 is positioned to engage the edge of the lowermost glass plate **18*b* of the stack and push such plate axially clear of the shoulder 51 so that it is free to drop down onto the lower track members 22 as best illustrated in FIG. 2 at 18*c*. When the pusher 52 retracts the stack moves down again until the lowermost plate is in the position of 18*b* for subsequent release. The side of the channel opposite the pusher is cut back to allow the pusher to slide a single plate sideways clear of the shoulder 51** but extended far enough to prevent two plates from moving with the pusher.

Figure 4:
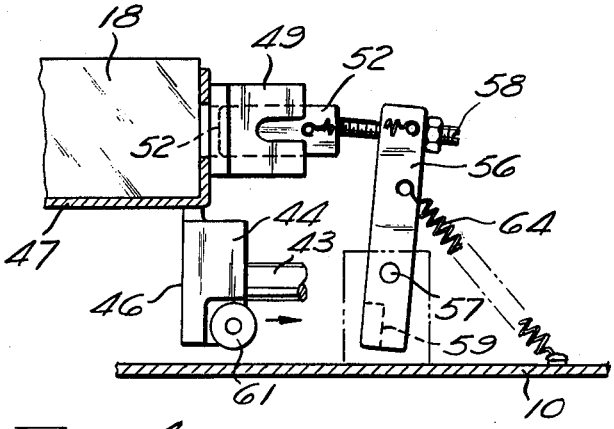
FIG. 4 is a diagrammatic fragmentary view taken generally along 4—4 of FIG. 3.

The escapement mechanism is preferably operated by the piston 43 of the pusher actuator. This operation is accomplished by a lever arm 56 which is pivoted at 57 and is provided with an adjusting screw 58 at its upper end. The screw engages the rearward end of the pusher 52 and when the lever arm 56 is rotated in a clockwise direction as illustrated in FIG. 3 (or an anti-clockwise direction as illustrated in FIG. 4) it pushes the pusher forward to eject a single plate **18*b*. The lever 56 is provided with a lateral projection 59 at its lower end which is engaged by a roller 61 mounted on the pusher plate 44 which operates to pivot the lever 56 to cause extension of the pusher 52 and movement of the lowermost plate 18*b* free of the shoulder 51. This operation occurs as the piston 44 retracts the pusher plate 44 clear of the escapement mechanism. When the retraction of the piston 43 causes the pusher to move the lowermost glass plate 18*b* clear of the shoulder 51 such plate is free to fall down to the position 18*c* illustrated in FIG. 2 for engagement by the pusher plate and movement along the track assembly 11 during the subsequent extension of the piston 43. Air jets supplied by pressure lines 62 and 63 impinge upon the plate 18*b* and insure that it falls away from the supply. Such air jets are desirable when the articles are glass plates which tend to remain together. The jet from the line 63 is preferably directed to the edge of the plate 18*b* which projects beyond the remaining portion of the stack when it is pushed forward by the pusher 52**.

A spring 64 is connected to the lever 56 to retract the lever as the piston extends and a second spring 66 is connected between the pusher 52 and lever to maintain the pusher in engagement with the adjusting screw 58.

Suitable guide strips 67 and 68 are provided to insure that the plate falling down to the position 18*c* remains in the proper position and orientation.

The second pusher 19 is also provided with an actuator 71 having a cylinder 72 mounted on the base 10 and a piston 73 which extends and retracts to move a pusher plate 74 which actually engages the plate 18*a* and moves the row of plates 18 within the track assembly 14.

The two actuators are preferably pneumatically operated from a source of air pressure through solenoid control valves connected for double action of the actuators. The solenoid valves and the source of pressure are not illustrated.

A pair of limit switches 76 and 77 are mounted adjacent to the track assemblies 11 and 14 respectively and operate to control the valves and in turn produce automatic cyclic operation of the machine. The switch 76 is engaged and operated by a projection 78 when the piston 43 moves to its extended position. Similarly, the switch 77 is engaged and operated by a projection 79 when the piston 73 moves to its extended position.

The circuit is arranged so that when the switch 76 is operated to indicate full extension of the piston 43 and the completion of the pushing operation of the pusher assembly 17, the control valve operated by the switch 76 causes the piston 43 to retract and initiates extension of the piston 73. When the piston 43 is retracted clear of the escapement mechanism it operates to allow a piece of glass at the position 18*b* to be released and to fall to the position 18*c*. While this is occurring the piston 73 is extending to push the glass plate 18*a* from the intersection of the two track assemblies into the track assembly 14. When it extends fully it operates the switch 77 which is connected to reverse the valves causing retraction of the piston 73 and extension of the piston 43. This way two actuators function out of phase and automatically cycle to progressively feed glass plates through the machine.

Adjustable valves, such as needle valves, are preferably provided in the pressure lines connecting the actuators, to control the velocity of the actuators. Such valves are adjusted to insure that the actuators are properly retracted before a subsequent extension occurs.

Figure 5:
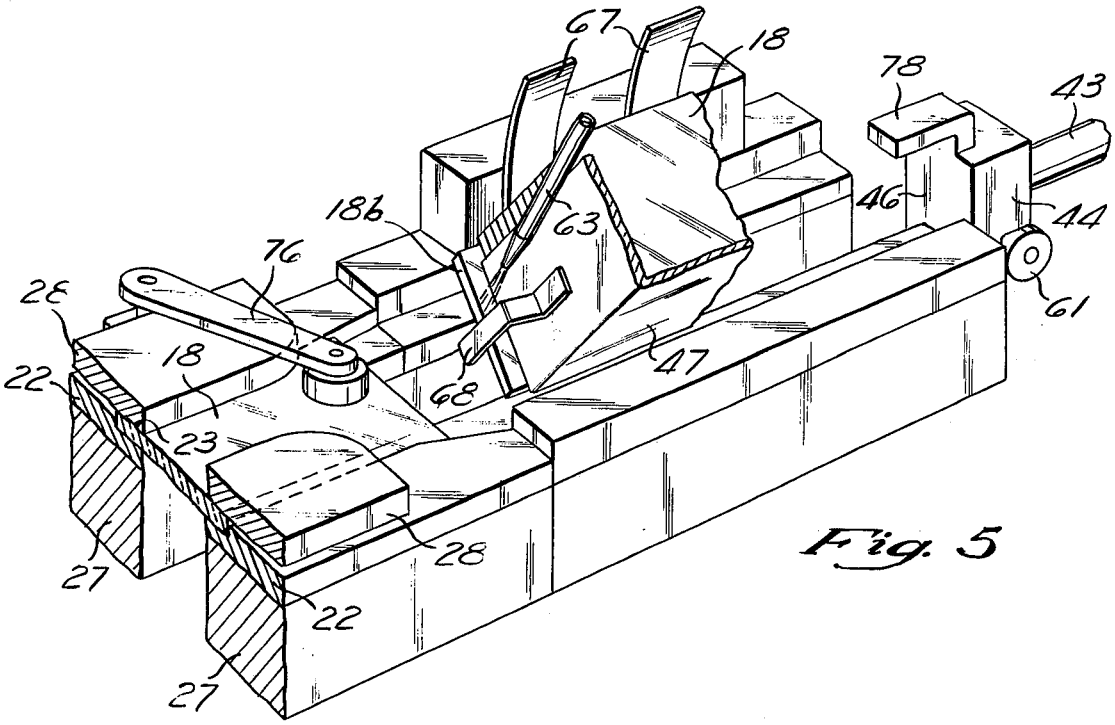
FIG. 5 is a perspective view of the entrance end to the first track means illustrating the first pusher with parts removed for purposes of illustration.

With the present invention a very simple structure permits the automatic edge finishing of rectangular plate like articles. It is not necessary to use power conveyor with the present invention and the glass plates are guided sufficiently well to insure that they move along the track systems and past the grinders even through only the end glass plate is pushed. The entrance ends of the two track assemblies are preferably beveled as best illustrated in FIG. 5 to insure smooth flow of the glass plates into the track assemblies.

Although a preferred embodiment of the invention is illustrated it is to be understood that various modifications and rearrangements may be resorted to without departing from the scope of the invention disclosed and claimed.

I claim:

1. A machine for grinding the edges of rectangular articles of glass or the like comprising first and second track means operable to respectively embrace first and second pairs of opposed edges of a row of abutting articles to support each article in said row against motion in all directions excepting along said track means and guide each piece within said row for movement along said track means, the exit end of said first track means intersecting the entrance end of said second track means at right angles, first and second pushers at the respective entrance ends of said track means operable with repeated cycles to engage one article and push it along said track means and thereby move the associated row along the associated track means toward the exit end thereof, said first pusher operating during each cycle to deliver a single article to the entrance end of said second track means, said second pusher operating out of phase with said first pusher to move said single article into said second track means and clear its entrance for a subsequent article, grinding means intermediate the ends of each of said track means operable to grind the opposed guided edges of articles as they move along the associated track means.

2. A machine as set forth in claim 1 wherein said first and second pushers each include piston cylinder actuators connected to operate out of phase.

3. A machine as set forth in claim 2 wherein feed means provide single articles from a supply of articles to the entrance end of said first track means for movement by said first pusher into said first track means.

4. A machine as set forth in claim 3 wherein said feed means is operated in timed relationship to said pushers by said actuator of said first pusher.

5. A machine as set forth in claim 1 wherein feed means provide single articles from a supply of articles to the entrance end of said first track means for movement by said first pusher into said first track means.

6. A machine as set forth in claim 1 wherein said track means include an adjustment for adjusting the clearance with respect to said articles.

7. A machine as set forth in claim 1 wherein said grinding means include grinding wheels with peripheral V-shape grooves to grind the edges of said articles.

8. A machine as set forth in claim 7 wherein said articles are glass plates.

* * * * *